US007198536B2

(12) United States Patent
Nuccio et al.

(10) Patent No.: US 7,198,536 B2
(45) Date of Patent: Apr. 3, 2007

(54) WATER DISC TOY

(76) Inventors: Mark C. Nuccio, 2687 Centre Ave., Bellmore, NY (US) 11710; Matthew D. Nuccio, 68-37 Harrow St., Forest Hills, NY (US) 11375

( * ) Notice: Subject to any disclaimer, the term of this patent is extended or adjusted under 35 U.S.C. 154(b) by 20 days.

(21) Appl. No.: 11/115,657

(22) Filed: Apr. 27, 2005

(65) Prior Publication Data

US 2005/0239366 A1 Oct. 27, 2005

Related U.S. Application Data

(60) Provisional application No. 60/565,790, filed on Apr. 27, 2004.

(51) Int. Cl.
*A63B 65/10* (2006.01)

(52) U.S. Cl. ..... 446/46; 446/487

(58) Field of Classification Search ..... 446/46–49, 446/487, 488; 273/353
See application file for complete search history.

(56) References Cited

U.S. PATENT DOCUMENTS

| | | | | |
|---|---|---|---|---|
| 957,742 | A | 5/1910 | Chiantore | |
| 1,369,830 | A | 3/1921 | Mitchell | |
| 2,640,699 | A | 6/1953 | Garbo | |
| 3,948,523 | A * | 4/1976 | Michael | 473/588 |
| 4,203,252 | A | 5/1980 | Howie | |
| 4,262,911 | A * | 4/1981 | Opresik et al. | 473/613 |
| 4,600,974 | A | 7/1986 | Lew et al. | |
| 4,822,048 | A | 4/1989 | Axup | |
| 5,092,608 | A | 3/1992 | Snipes | |
| 5,092,807 | A | 3/1992 | Lew et al. | |
| 5,277,641 | A * | 1/1994 | Gable et al. | 446/46 |
| 5,288,256 | A | 2/1994 | Lee et al. | |
| 5,348,509 | A | 9/1994 | Riccardi et al. | |
| 5,360,363 | A * | 11/1994 | Levin | 446/46 |
| 5,393,256 | A | 2/1995 | Mitchell et al. | |
| 5,538,455 | A | 7/1996 | James, II | |
| 5,553,570 | A * | 9/1996 | VanNatter et al. | 119/709 |
| 5,575,479 | A | 11/1996 | Ayres | |
| 5,797,811 | A | 8/1998 | Vestal | |
| 5,882,239 | A | 3/1999 | Trichak | |
| 6,231,414 | B1 | 5/2001 | Ho | |

* cited by examiner

*Primary Examiner*—Kien Nguyen
(74) *Attorney, Agent, or Firm*—Frost Brown Todd LLC

(57) ABSTRACT

A toy throwing disc that is tossed between players has a unique feature of having the compartment in the center filled with a liquid or gel that creates a stabilizing effect. The water disc is a plastic molded flying disc with an outside molded rim and a sealed compartment in the top that holds water, and additionally may hold gel, glitter, colorful beads, decorative parts, etc. The top and bottom of the center portion is clear to make the contents visible from both sides. The center compartment stabilizes the disc by centrifugal force, creating extra speed and stabilization. The compartment also serves as a chamber that allows for attractive designs to constantly change by movement of the liquid and glitter or objects incorporated in the liquid when the disc is tossed.

5 Claims, 12 Drawing Sheets

WATER DISC TOY

CROSS REFERENCE TO RELATED APPLICATIONS

The present application hereby claims the benefit of the provisional patent application entitled "WATER DISC", Ser. No. 60/565,790, filed on 27 Apr. 2004.

FIELD OF THE INVENTION

The present invention relates, in general, to toys intended to be thrown for amusement, and more particularly to flying disc toys.

BACKGROUND OF THE INVENTION

Spinning toys have long been popular, such as aerodynamic spinning discs. However, as children have increasingly become used to interactive and vibrant amusement devices, it is desirable to incorporate additional visual effects in toys that may be tossed.

BRIEF SUMMARY OF THE INVENTION

The invention overcomes the above-noted and other deficiencies of the prior art by providing an aerodynamic disc that has a flat cylindrical recess centrally aligned therein closed on a top and bottom surface by a transparent barrier such that thin shaped members suspended in a liquid in the flat cylindrical recess may be seen as they swirl and move.

These and other objects and advantages of the present invention shall be made apparent from the accompanying drawings and the description thereof.

BRIEF DESCRIPTION OF THE FIGURES

The accompanying drawings, which are incorporated in and constitute a part of this specification, illustrate embodiments of the invention, and, together with the general description of the invention given above, and the detailed description of the embodiments given below, serve to explain the principles of the present invention.

DETAILED DESCRIPTION OF THE INVENTION

Figure 1:
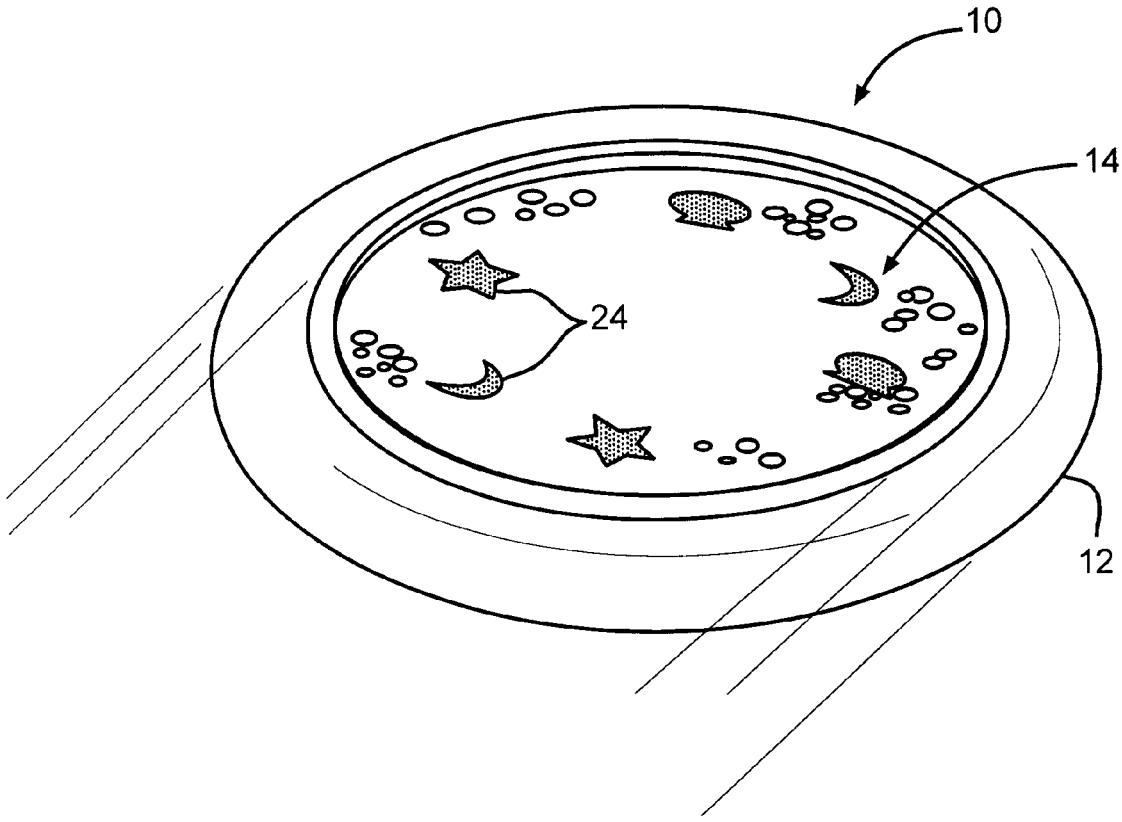
FIG. 1 is a perspective view of an aerodynamic disc toy with a sealed transparent circular compartment holding thin swirling shaped members suspended in a liquid.
Figure 2:
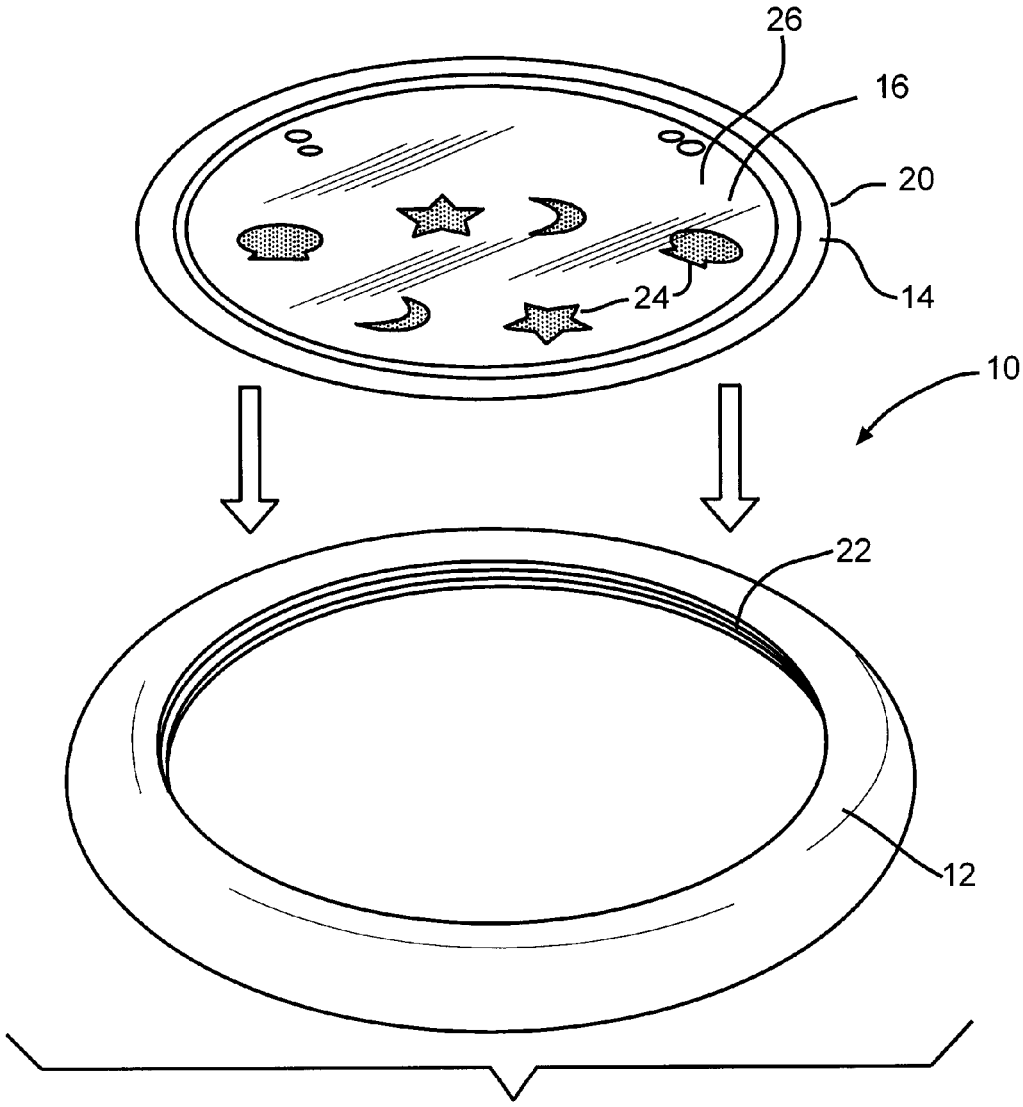
FIG. 2 is a perspective view of the transparent circular compartment disassembled from an opaque aerodynamic ring of the aerodynamic disc toy of FIG. 1.
Figure 3:
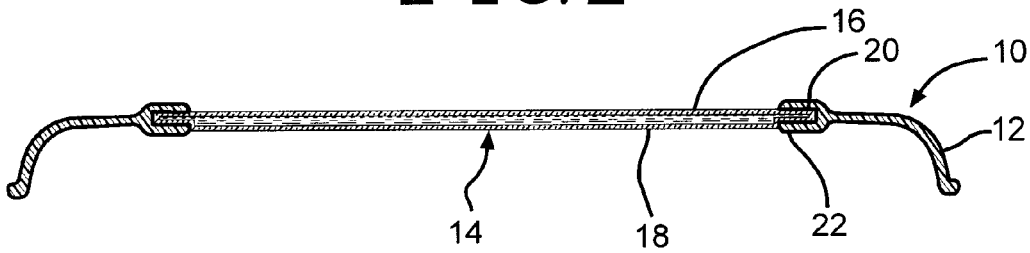
FIG. 3 is a side perspective view in elevation of the aerodynamic disc toy of FIG. 1 in longitudinal cross section.
Figure 4:
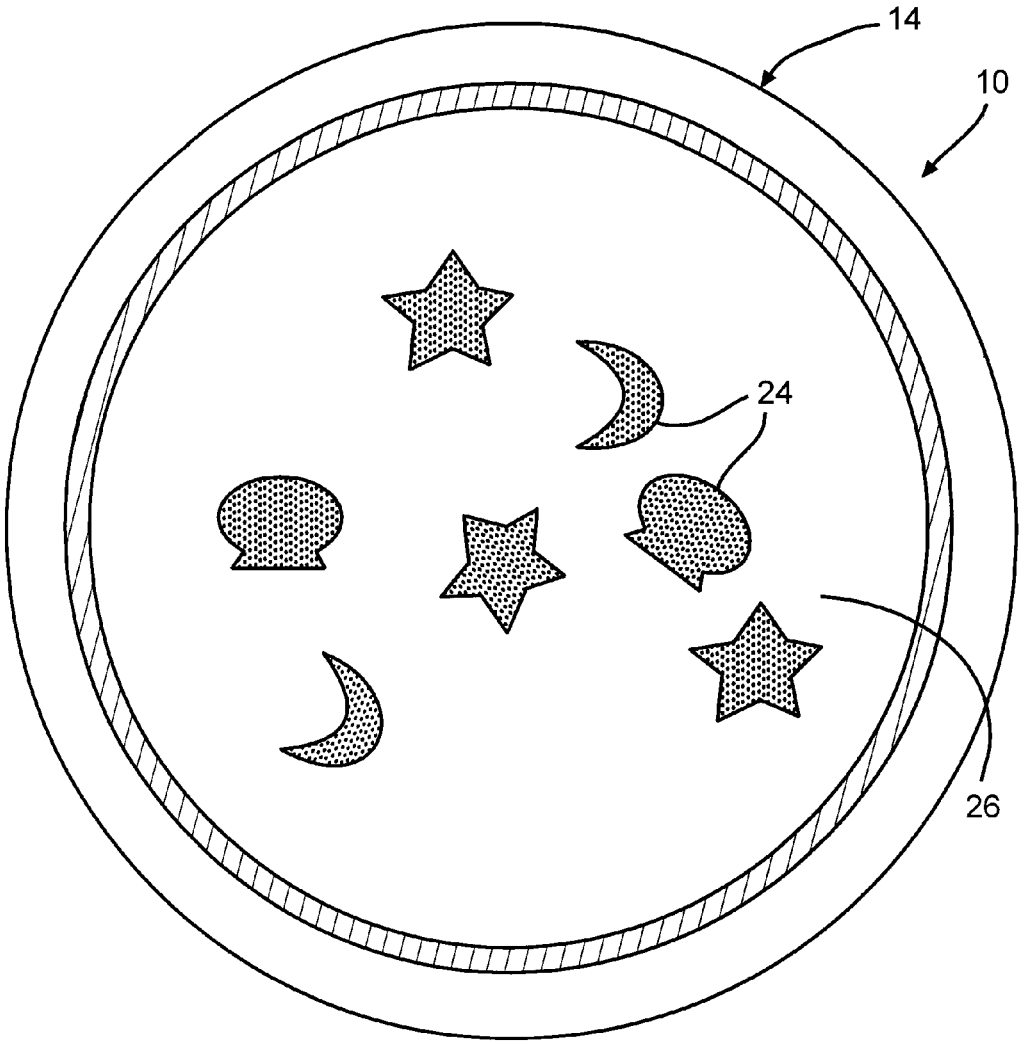
FIG. 4 is a top view of the transparent circular compartment of FIG. 2.
Figure 5:
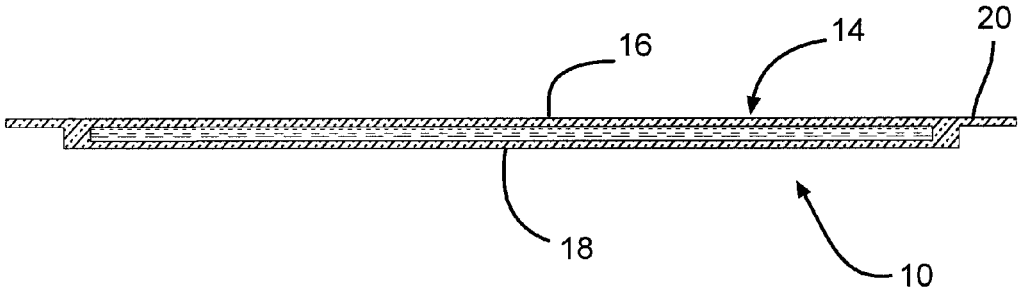
FIG. 5 is a side view of the transparent circular compartment of FIG. 4.
Figure 6:
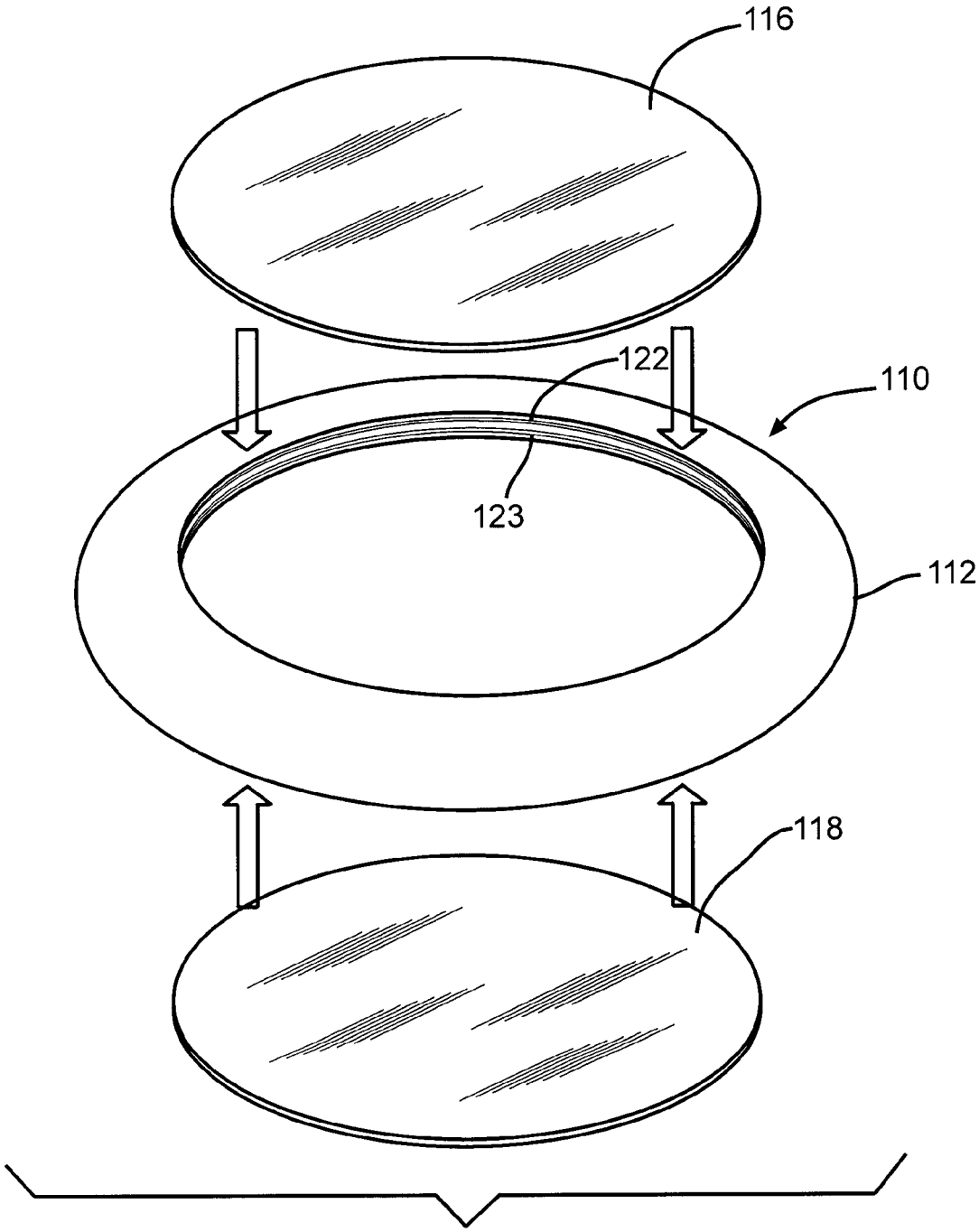
FIG. 6 is a perspective disassembled view of an alternative aerodynamic disc toy having an assembled transparent circular compartment holding decorations.
Figure 7:
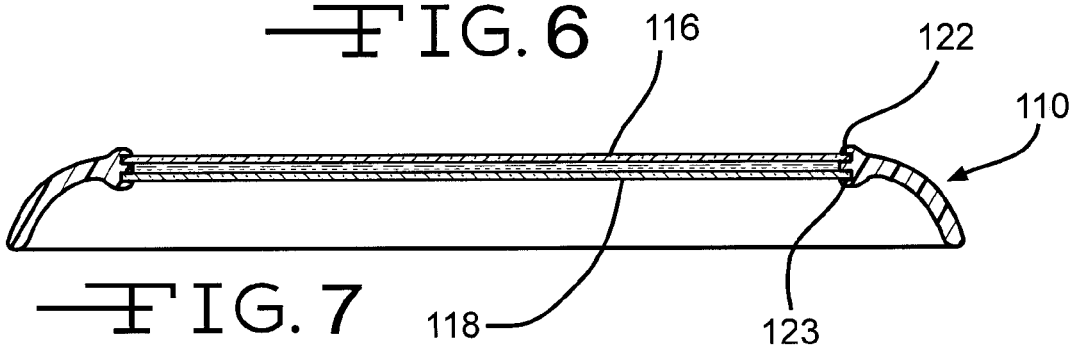
FIG. 7 is a side view in longitudinal cross section of the alternate aerodynamic toy of FIG. 6 showing upper and lower disc channels holding upper and lower transparent circular windows.
Figure 7A:
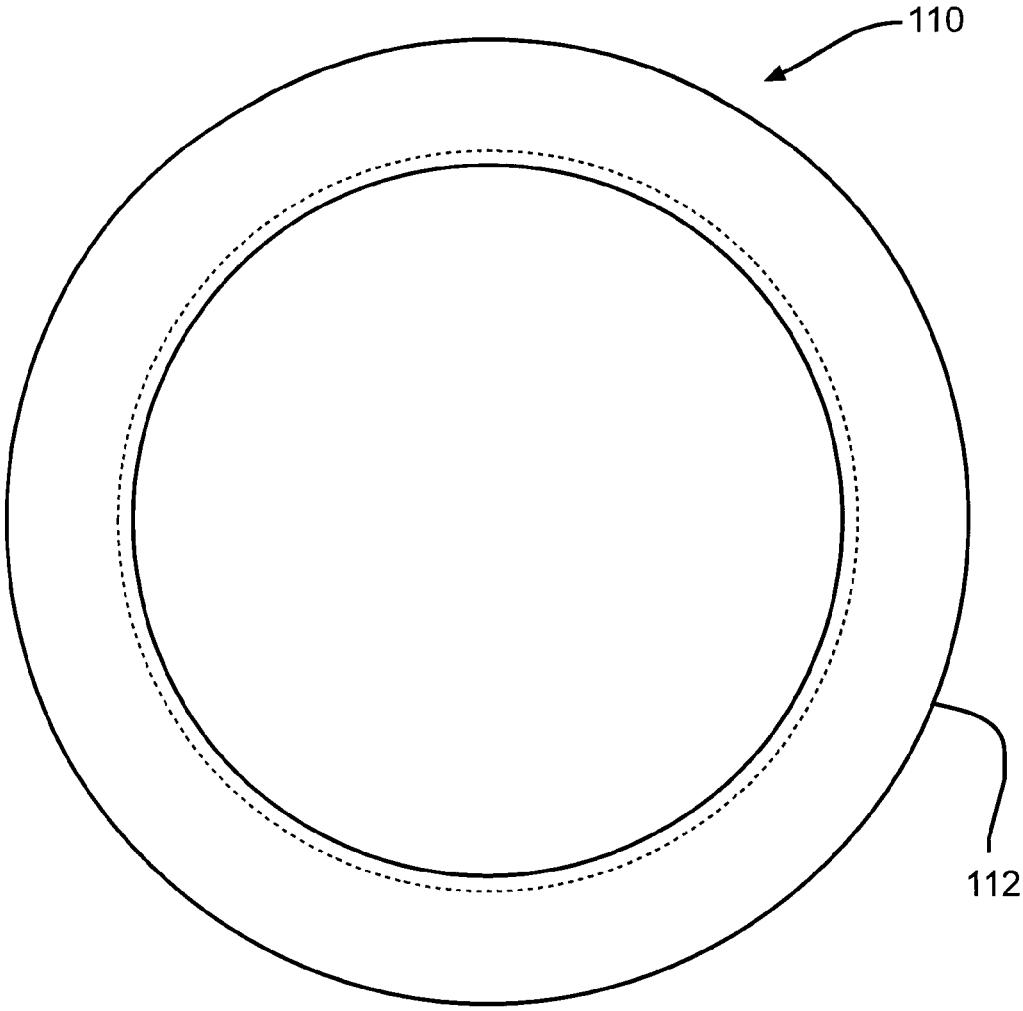
FIG. 7A is a top view of an outer ring of the aerodynamic disc toy of FIG. 6.
Figure 7B:
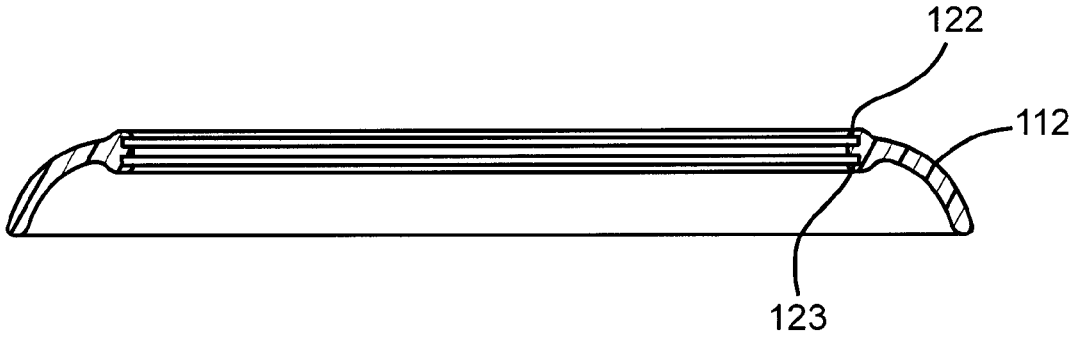
FIG. 7B is a side view of the outer ring of FIG. 7A.
Figure 8:
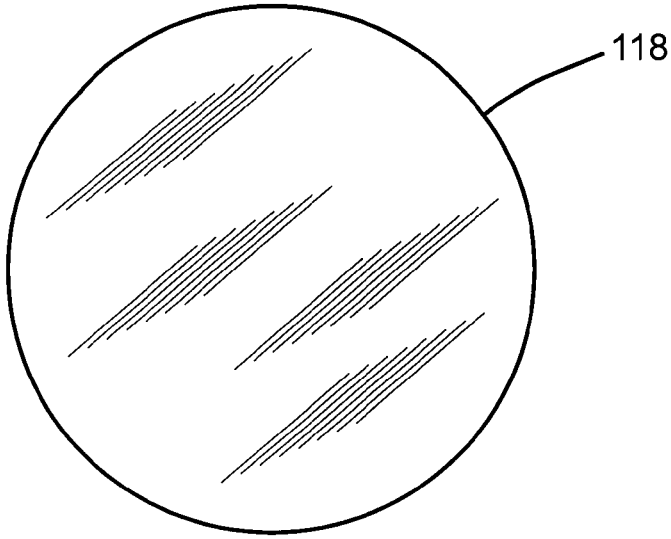
FIG. 8 is a top view of the upper and lower transparent circular windows of FIG. 7.
Figure 8A:
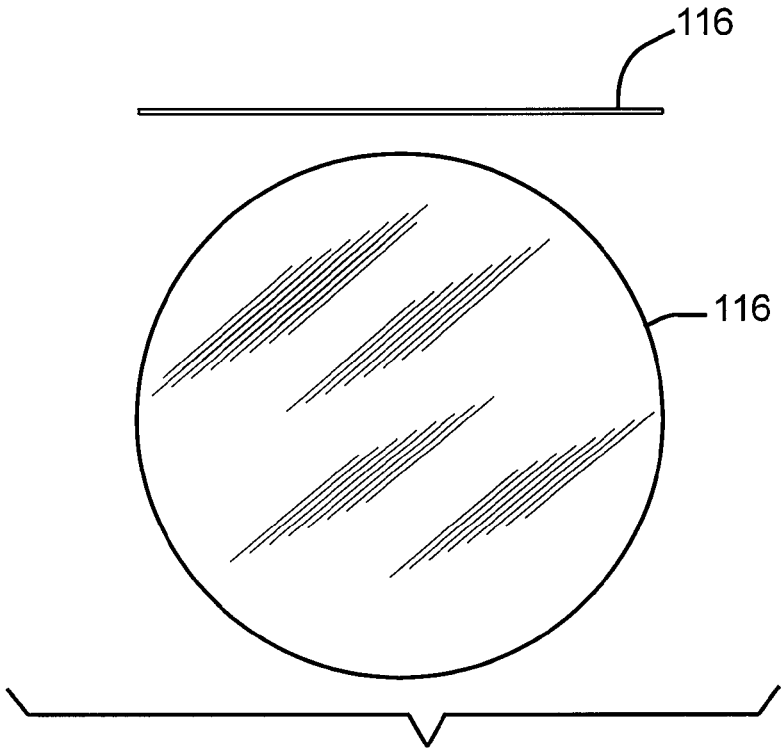
FIG. 8A is a side view of the upper transparent circular window of FIG. 7.
Figure 8B:
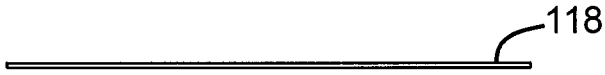
FIG. 8B is a side view of the lower transparent circular window of FIG. 7.
Figure 9:
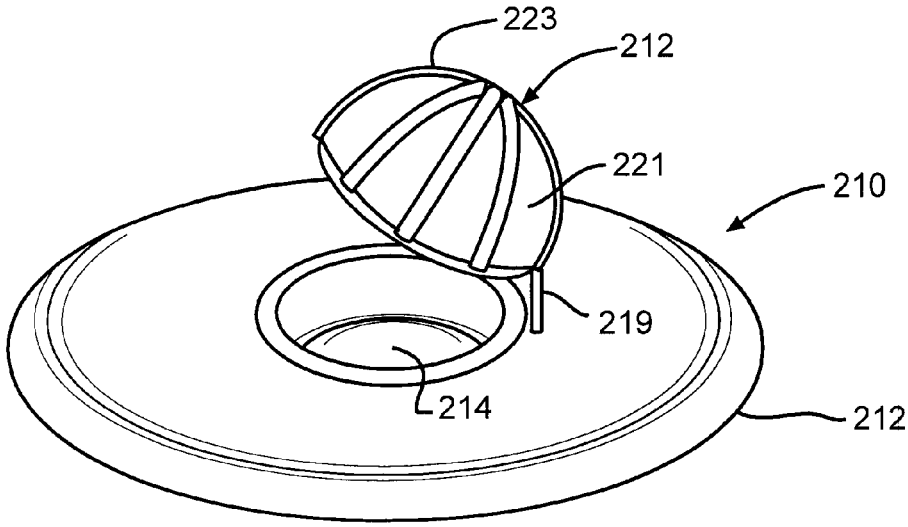
FIG. 9 is a perspective view of a further alternative aerodynamic disc toy having a central reservoir that releases water upon impact.
Figure 10:
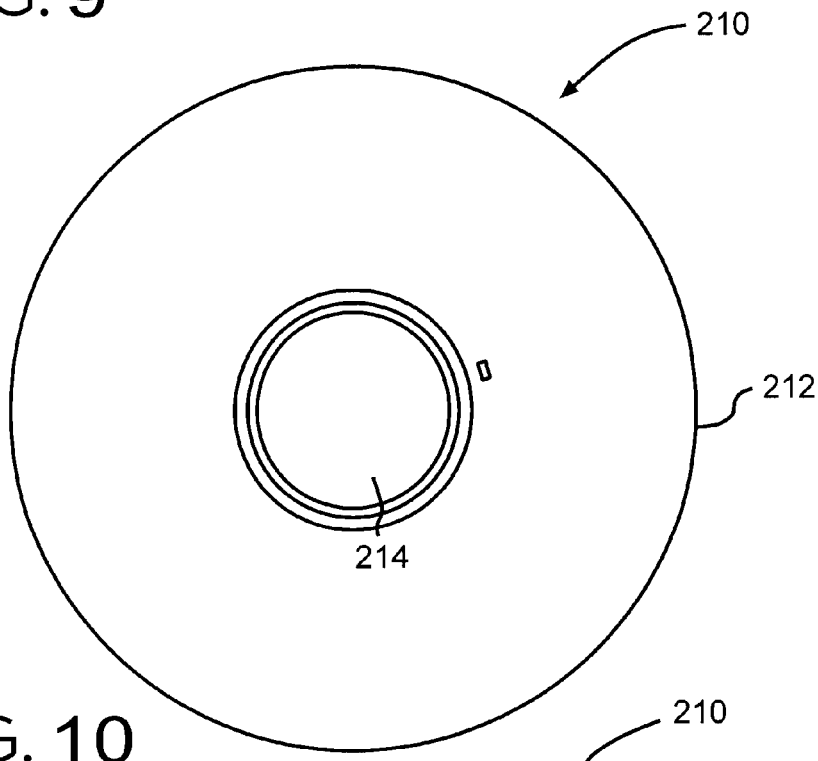
FIG. 10 is a top view of the aerodynamic disc toy of FIG. 9.
Figure 11:
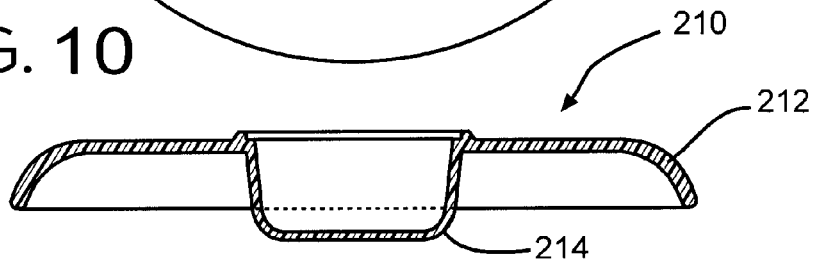
FIG. 11 is a side view in longitudinal cross section of the further alternative aerodynamic disc toy of FIG. 9.
Figure 12A:
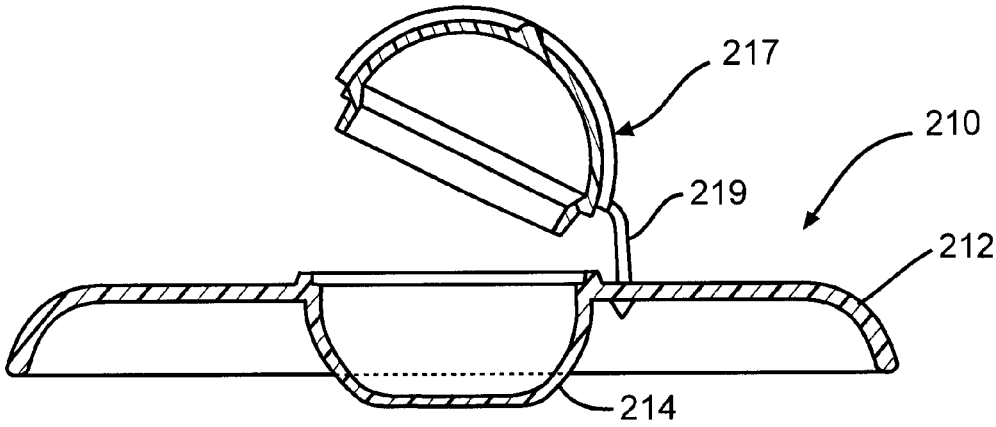
FIG. 12A is a side view in elevation in longitudinal cross section of the alternative aerodynamic disc toy of FIG. 11 with a domed enclosure opened to fill a central reservoir.
Figure 12B:
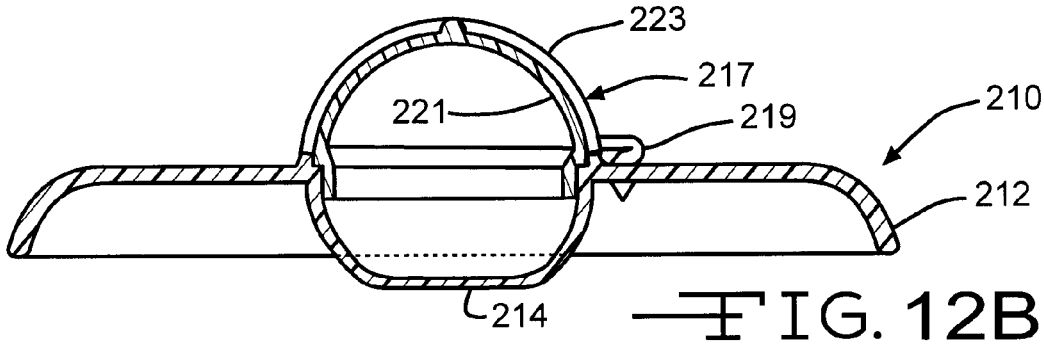
FIG. 12B is a side view in elevation in longitudinal cross section of the alternative aerodynamic disc toy of FIG. 11 with a domed enclosure sealed.
Figure 12C:
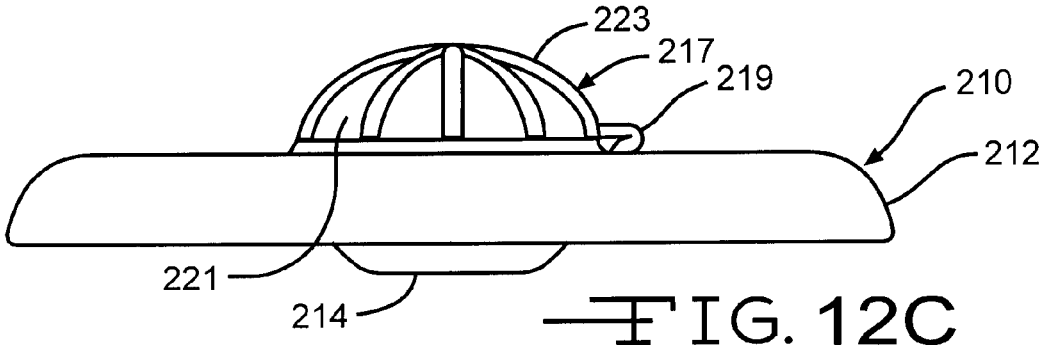
FIG. 12C is a side view of the alternative aerodynamic disc toy of FIG. 11 with a domed enclosure depressed to effect sealing.
Figure 12D:
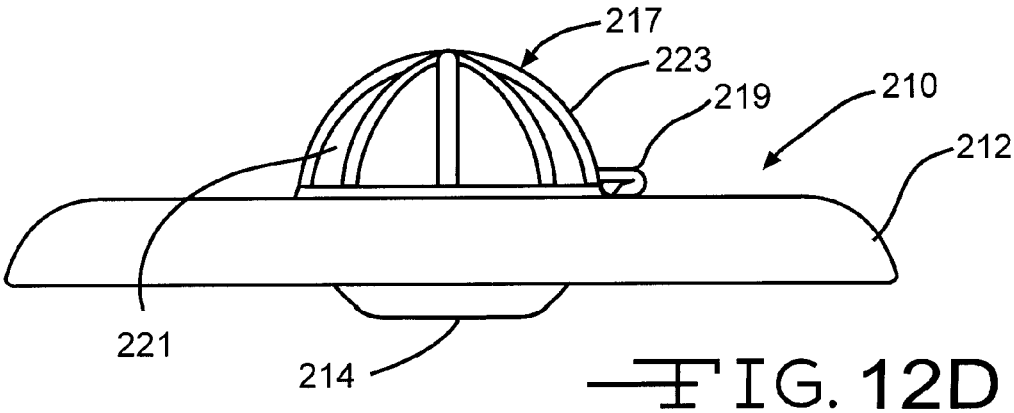
FIG. 12D is a side view of the alternative aerodynamic disc toy of FIG. 12B.
Figure 13A:
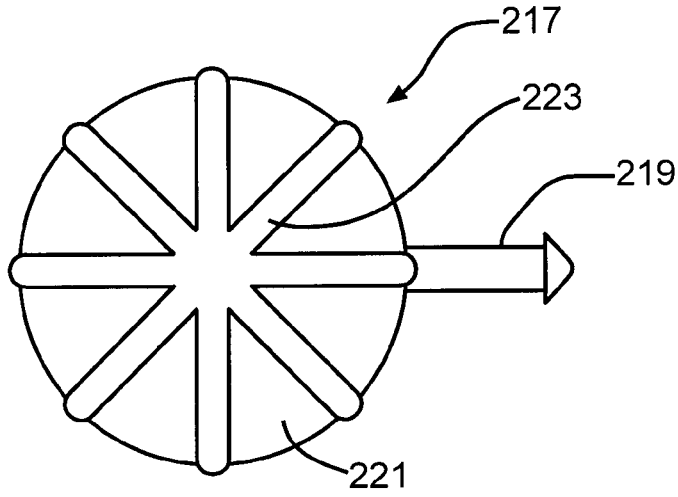
FIG. 13A is a top view of a disassembled domed enclosure of the alternative aerodynamic disc toy of FIG. 11.
Figure 13B:
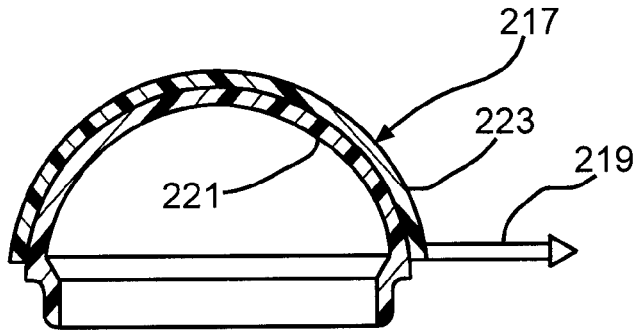
FIG. 13B is a side view in longitudinal cross section of the domed enclosure FIG. 13A.
Figure 13C:
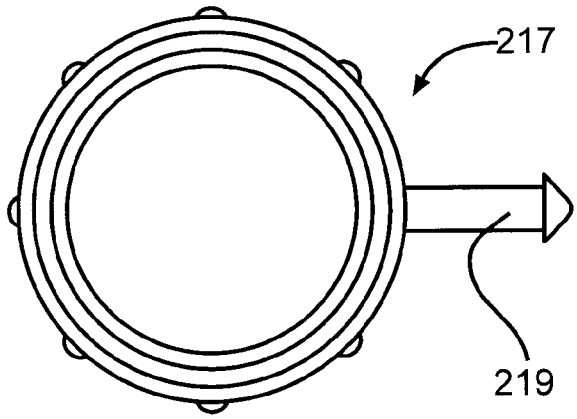
FIG. 13C is a bottom view of the domed enclosure of FIG. 13A.

In FIGS. 1–5, an aerodynamic disc toy 10 has a ring 12 shaped to hold a central reservoir, in particular a sealed flat cylindrical member 14 has parallel, spaced apart upper and lower transparent circular windows 16, 18 that are sealed at their outer periphery with an outer rim 20 that is gripped within an inner circular groove 22 of the ring 12 (FIG. 5). Thin colorful decorations 24 (FIGS. 1, 2, 4) are suspended within liquid 26 between the windows 16, 18.

In FIGS. 6–8B, an alternative disc toy 110 has a ring 112 shaped to hold a central reservoir that is assembled. In particular, the ring 112 has upper and lower inner circular grooves 122, 123 that receive respectively parallel, spaced apart upper and lower transparent circular windows 116, 118, between which liquid and decorations may be contained (not shown).

In FIGS. 9–13C, a further alternative aerodynamic disc toy 210 with a ring 212 is attached to a central reservoir that is configured to release liquid upon impact. In particular, a central cup 214 is attached in the ring along its central axis, extending lower then the outer edges of the ring 212. A domed enclosure 217 has a flexible snap fitting 219 that remains attached when the domed enclosure is unsealed from the central cup 214 to fill with water. The domed enclosure 217 comprises an inner domed seal member 221 and an outer domed lattice 223.

Figure 14:
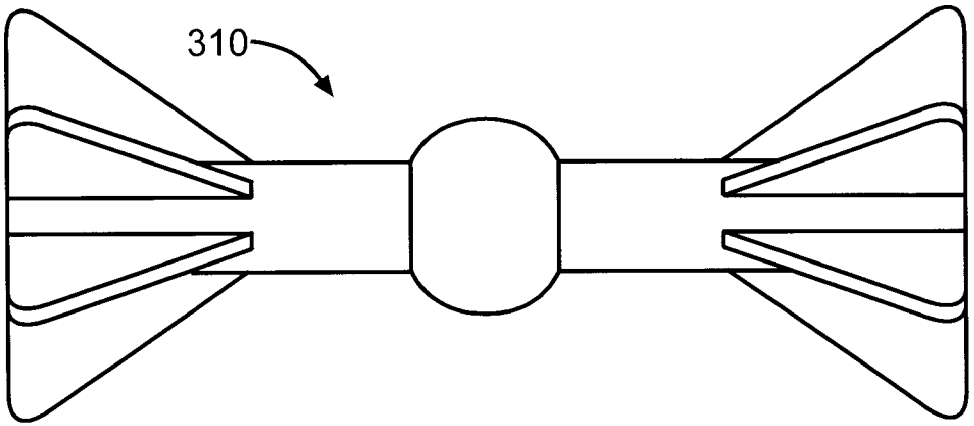
FIG. 14 is a side view of a baton toy.
Figure 15:
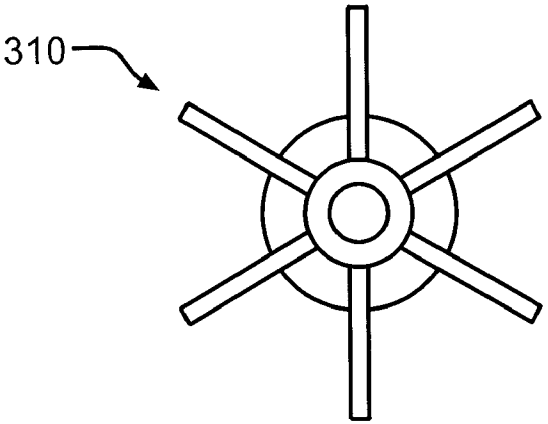
FIG. 15 is an end view of the baton toy.

In FIGS. 14–15, a baton toy 310 is depicted.

Figure 17:
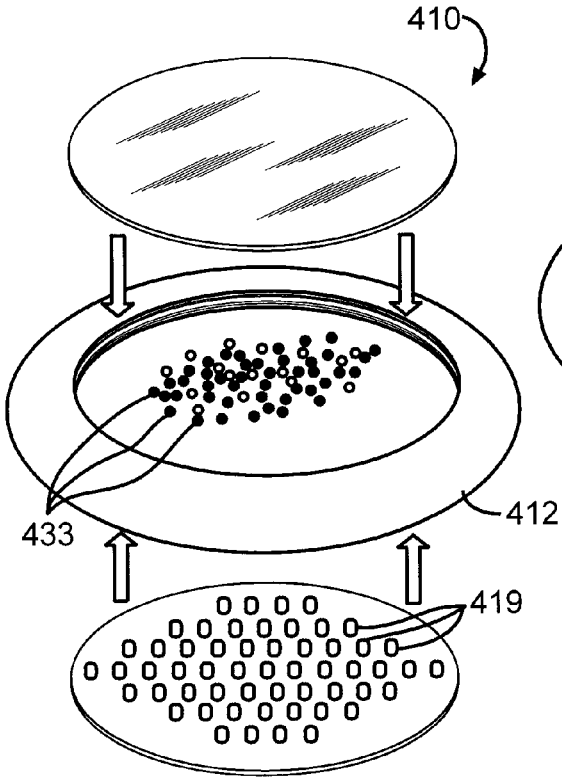
FIG. 17 is a perspective disassembled view of the aerodynamic disc toy of FIG. 16.
Figure 16:
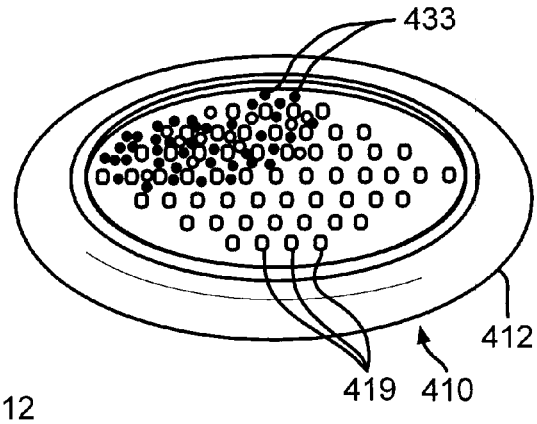
FIG. 16 is a perspective view of another alternative aerodynamic disc toy having a sound producing central cavity.
Figure 18:
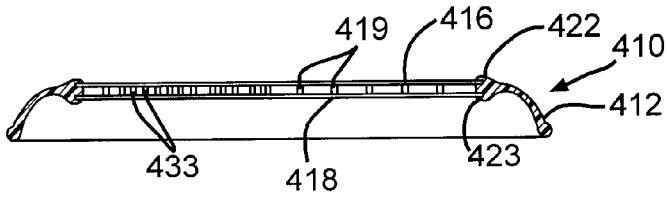
FIG. 18 is a side view in longitudinal cross section of the aerodynamic disc toy of FIG. 16.

In FIGS. 16–18, an aerodynamic disc toy 410 has a ring 412 shaped to hold a central reservoir that is assembled. In particular, the ring 412 has upper and lower inner circular grooves 422, 423 that receive respectively parallel, spaced apart upper and lower transparent circular windows 416, 418, at least one of which includes inward projections 419 such that small ball bearings 433 create a rain-like noise when bouncing around therein.

Figure 19:
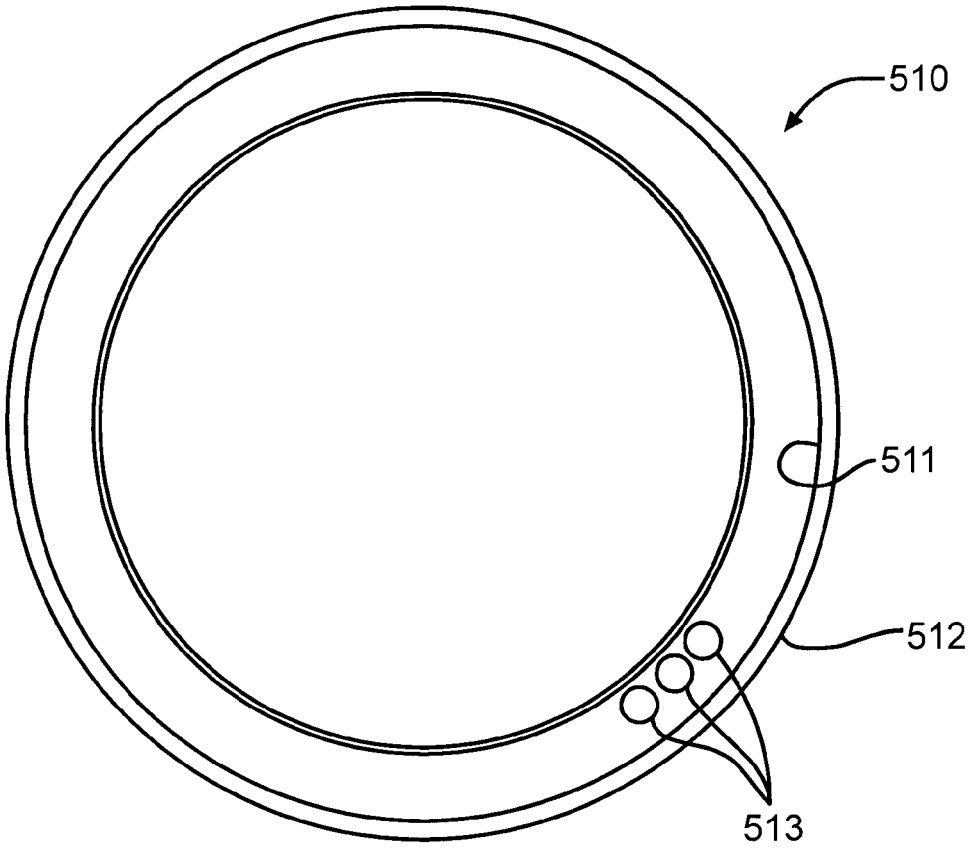
FIG. 19 is a top view of yet another alternative aerodynamic disc toy having an annular cavity for producing visual and audible effects.
Figure 20:
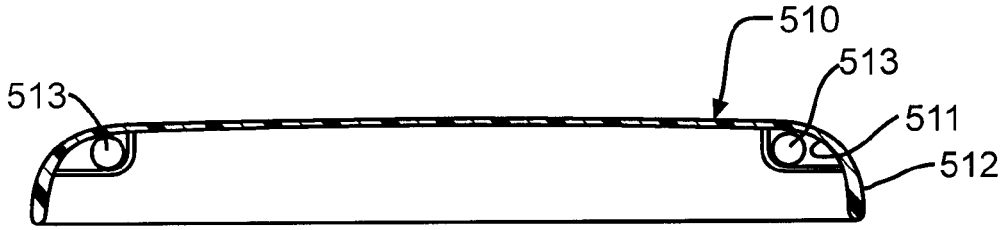
FIG. 20 is a side view in longitudinal cross section of the aerodynamic disc toy of FIG. 19.

In FIGS. 19–20, yet another alternative aerodynamic disc toy 510 has an annular cavity 511 formed in a ring 512 that holds one ore more ball bearings 513 for producing visual and audible effects.

While the present invention has been illustrated by description of several embodiments and while the illustrative embodiments have been described in considerable detail, it is not the intention of the applicants to restrict or in any way limit the scope of the appended claims to such detail. Additional advantages and modifications may readily appear to those skilled in the art.

What is claimed is:

1. A toy, comprising:

an annular ring having a central opening and a circularly symmetric downwardly sloped outer periphery and operatively configured to aerodynamically glide when thrown with an imparted spin;

a circular compartment attached across the central opening of the annular ring comprising transparent upper and lower windows; and decorative objects sized for movement placed in the circular compartment;

wherein the circular compartment further comprises a sealed hollow disc formed of transparent polymer and having an outer rim, the annular ring having an inner groove receiving the outer rim.

2. A toy comprising:

an annular ring having a central opening and a circularly symmetric downwardly sloped outer periphery and operatively configured to aerodynamically glide when thrown with an imparted spin;

a circular compartment attached across the central opening of the annular ring comprising transparent upper and lower windows; and decorative objects sized for movement placed in the circular compartment;

wherein the annular ring has upper and lower inner circular grooves formed in the central opening receiving respectively the transparent upper and lower windows.

3. A toy comprising:

an annular ring having a central opening and a circularly symmetric downwardly sloped outer periphery and operatively configured to aerodynamically glide when thrown with an imparted spin;

a circular compartment attached across the central opening of the annular ring comprising transparent upper and lower windows; and decorative objects sized for movement placed in the circular compartment;

wherein a selected one of the upper and lower windows further comprises a plurality of inward projections, the decorative objects comprising a ball or balls for making noise when thrown.

4. A toy, comprising:

an annular ring having a central opening and a circularly symmetric downwardly sloped outer periphery and operatively configured to aerodynamically glide when thrown with an imparted spin; and a central compartment attached across the central opening of the annular ring comprising a lower reservoir cup projecting downwardly lower than the outer periphery of the annular ring and an enclosure to selectively close an upward opening the lower reservoir cup;

a releasable engaging surface formed between the upward opening of the lower reservoir cup and the enclosure is operatively configured to open for filling the circular compartment, to seal when depressed into the lower reservoir cup for throwing, and to release allowing water to project out of the lower reservoir cup upon impact.

5. The toy of claim 4, wherein the releasable engaging surface comprises an interference fit.

* * * * *

UNITED STATES PATENT AND TRADEMARK OFFICE

CERTIFICATE OF CORRECTION

PATENT NO. : 7,198,536 B2
APPLICATION NO. : 11/115657
DATED : April 3, 2007
INVENTOR(S) : Mark C. Nuccio and Matthew D. Nuccio It is certified that error appears in the above-identified patent and that said Letters Patent is hereby corrected as shown below:

Column 4, line 33, "an upward opening the lower reservoir cup;" should be --an upward opening of the lower reservoir cup; --.

Signed and Sealed this

Fifteenth Day of May, 2007

JON W. DUDAS
*Director of the United States Patent and Trademark Office*